US010874211B2

(12) United States Patent
Kusick

(10) Patent No.: US 10,874,211 B2
(45) Date of Patent: Dec. 29, 2020

(54) SHELVING SYSTEM FOR CELLAR

(71) Applicants: CELLAR SOLUTIONS INC., Surrey (CA); 9300-5965 QUEBEC INC., Montreal (CA)

(72) Inventor: Michael Kusick, White Rock (CA)

(73) Assignees: Cellar Solutions Inc., Surrey (CA); 9300-5965 Québec Inc., Montréal (CA)

( * ) Notice: Subject to any disclaimer, the term of this patent is extended or adjusted under 35 U.S.C. 154(b) by 0 days.

(21) Appl. No.: 16/313,966

(22) PCT Filed: Apr. 28, 2017

(86) PCT No.: PCT/CA2017/050521

§ 371 (c)(1),
(2) Date: Dec. 28, 2018

(87) PCT Pub. No.: WO2018/068128

PCT Pub. Date: Apr. 19, 2018

(65) Prior Publication Data

US 2019/0313792 A1 Oct. 17, 2019

Related U.S. Application Data

(60) Provisional application No. 62/407,737, filed on Oct. 13, 2016.

(51) Int. Cl.
*A47B 73/00* (2006.01)

(52) U.S. Cl.
CPC ..... *A47B 73/008* (2013.01); *A47B 73/002* (2013.01)

(58) Field of Classification Search
CPC ... A47B 73/008; A47B 73/002; A47B 73/004; A47B 73/006; A47B 73/00;
(Continued)

(56) References Cited

U.S. PATENT DOCUMENTS 3,403,789 A 10/1968 La Morte et al.
4,577,765 A 3/1986 Crosby
(Continued)

FOREIGN PATENT DOCUMENTS

CA 2472096 A1 8/2003
CN 203897879 U 10/2014
(Continued)

OTHER PUBLICATIONS

Office Action of Canadian Application No. 3,029,449 dated Mar. 25, 2019, 4 pages.
(Continued)

*Primary Examiner* — Patrick D Hawn
(74) *Attorney, Agent, or Firm* — Brooks Kushman P.C.

(57) ABSTRACT

A shelving system for storing and displaying bottles within a cellar. The shelving system includes at least one rack for supporting and displaying bottles, the least one rack being mountable onto a given wall of the cellar and being displaceable with respect to said given wall so as to be displaced in and out of the cellar along an operative directional axis. The shelving system also includes at least one recess provided about the at least one rack, each recess being positioned, shaped and sized for receiving a corresponding bottle, and each recess being disposed about the at least one rack, at an angle with respect to the operative directional axis of the at least one rack, so as to allow peripheral side surfaces of bottles resting on the at least one rack to face a front portion of the cellar.

19 Claims, 17 Drawing Sheets

(58) Field of Classification Search
CPC ..... F25D 2331/803; F25D 2331/023; F25D 2331/021; F25D 2331/00; F25D 25/02; F25D 25/024; F25D 31/007
USPC ..... 211/74, 75
See application file for complete search history.

(56) References Cited

U.S. PATENT DOCUMENTS

| | | | | |
|---|---|---|---|---|
| 6,763,956 | B2 * | 7/2004 | Woods | A47B 73/00 211/74 |
| 6,981,597 | B2 * | 1/2006 | Cash | A47B 73/008 211/74 |
| 7,063,219 | B2 | 6/2006 | Fann et al. | |
| 7,204,570 | B2 * | 4/2007 | Benitsch | F25D 25/024 211/153 |
| D554,160 | S * | 10/2007 | Morrison | D15/89 |
| 7,350,647 | B2 * | 4/2008 | Haller | A47B 57/04 211/75 |
| 7,806,278 | B2 * | 10/2010 | Brida | A47B 73/00 211/74 |
| 8,132,871 | B1 | 3/2012 | Caruso | |
| 8,276,769 | B2 * | 10/2012 | Hogeback | A47F 7/28 211/74 |
| 8,684,194 | B2 * | 4/2014 | McCain | A47B 73/002 211/75 |
| 8,833,875 | B2 | 9/2014 | Arslankiray et al. | |
| 8,869,997 | B2 | 10/2014 | Collini | |
| D726,455 | S * | 4/2015 | Collini | D6/661 |
| 9,078,516 | B2 * | 7/2015 | Vogel | A47B 57/04 |
| 9,251,724 | B2 | 2/2016 | Hottmann et al. | |
| 9,326,602 | B2 | 5/2016 | Gupta | |
| D826,995 | S * | 8/2018 | Diamond | D15/89 |
| D847,220 | S * | 4/2019 | Strum | D15/89 |
| D849,065 | S * | 5/2019 | Diamond | D15/89 |
| 2005/0258118 | A1 * | 11/2005 | Lee | A47B 55/02 211/134 |
| 2006/0219648 | A1 | 10/2006 | Vinals Calduch | |
| 2007/0176529 | A1 * | 8/2007 | Benitsch | F25D 25/024 312/408 |
| 2007/0228909 | A1 | 10/2007 | Hwang et al. | |
| 2009/0120886 | A1 | 5/2009 | Weiss et al. | |
| 2009/0152219 | A1 | 6/2009 | Brida | |
| 2009/0178427 | A1 | 7/2009 | Eichman | |
| 2012/0273444 | A1 | 11/2012 | McCain | |
| 2013/0119004 | A1 * | 5/2013 | Lange | A47B 73/00 211/74 |
| 2013/0146552 | A1 | 6/2013 | Grimes | |
| 2013/0233814 | A1 * | 9/2013 | Gupta | A47B 57/38 211/74 |
| 2015/0034577 | A1 | 2/2015 | Cash | |
| 2016/0037917 | A1 * | 2/2016 | Li | A47B 73/006 211/74 |
| 2016/0183679 | A1 | 6/2016 | McCain | |

FOREIGN PATENT DOCUMENTS

| | | | |
|---|---|---|---|
| CN | 205493139 | U | 8/2016 |
| DE | 202013105392 | U1 | 2/2014 |
| DE | 102014108579 | A1 | 12/2015 |
| FR | 1577963 | A | 8/1969 |
| FR | 2869517 | B1 | 11/2005 |
| FR | 2870699 | A1 | 12/2005 |
| FR | 2929812 | A1 | 10/2009 |
| JP | 2001197975 | A | 7/2001 |
| JP | 2001240225 | A1 | 9/2001 |
| WO | 2005048779 | A1 | 6/2005 |
| WO | 2005055766 | A1 | 6/2005 |

OTHER PUBLICATIONS

Written Opinion of the International Searching Authority for International Application No. PCT/CA2017/050521 dated Sep. 5, 2017, 4 pgs.
International Publication No. WO2018/068128A1 for International Application No. PCT/CA2017/050521 with International Search Report dated Apr. 19, 2018, 57 pgs.

* cited by examiner

SHELVING SYSTEM FOR CELLAR

CROSS-REFERENCE TO RELATED APPLICATION

This application is the U.S. national phase of International Patent Application No. PCT/CA2017/050521 filed on Apr. 28, 2017, which claims the benefit of U.S. Provisional Patent Application No. 62/407,737 filed on Oct. 13, 2016, the disclosures of which are incorporated in their entirety by reference herein.

FIELD OF THE INVENTION

The present invention relates to the field of shelving systems for confined spaces. More particularly, and according to a possible intended use, the present invention relates to a shelving system for cellars, and also relates to a kit with components for assembling the same, and to a confined space (ex. cellar) provided with such a shelving system, as well as to corresponding methods of assembling, operating and use associated thereto.

BACKGROUND

Conventional cellars and corresponding shelving systems thereof, such as the ones exemplified in FIGS. 1 and 2, for instance, are well known in the art.

Indeed, these conventional cellars can typically store a large number of bottles. However, accessing the bottles is sometimes inconvenient and remains difficult. For instance, a user normally has to open the door of the cellar in order to identify and select a given bottle. In some cases, the user even has to manually take some bottles out of the cellar in order to access the bottles stored in the back portion of the cellar. The need to open the door to identify and select bottle(s), and/or the manipulations required in order to be able to take the desired bottle(s) out of the cellar, is not optimal for various reasons, including the conservation of products (ex. liquids, etc.) contained in the bottles, such as wine, liquor and/or the like, as it disturbs the air flow within the cellar, and may also adversely affect the temperature distribution within the cellar, etc. An additional disadvantage resulting from this conventional type of cellar and/or way of operating is the additional and wasteful energy consumption being required to compensate for "cool/cold" air losses when the door is opened simply to be able to "consult" and/or "select" the bottles that are stored inside the cellar, etc. Moreover, conventional cellars lack an essential functional feature, in that, because a user is exposed only to bottle necks and/or bases, the user cannot easily and conveniently identify a particular bottle within the cellar, which is very undesirable, for obvious reasons.

Known to the Applicant(s) are various documents that relate to cellars and/or corresponding shelving systems.

For example, U.S. Pat. No. 4,577,765, granted on Mar. 25, 1986, to CROSBY, relates to a "wine rack". This document describes a wine rack for horizontally supporting a plurality of wine bottles. The wine bottles are mounted in a manner so as to allow the wine and labels to be clearly viewed without disturbing the wine bottle. The wine rack allows the wine bottles to be easily removed or easily installed on the rack.

U.S. Pat. No. 8,869,997 B2, granted on Oct. 28, 2014, to COLLINI, relates to a "storage apparatus for containers". This document describes a storage apparatus for containers, which have a diameter at one end which is different from the diameter at the other end, comprising supports for two rests, projecting from said supports, for containers positioned side by side transverse to the removal direction, one rest supporting one side of the container and the other rest supporting the other side, the supports of the rests being mounted adjustably relative to one another on a mounting. The rests are mounted at different heights from one another on the supports thereof for oblique storage of the containers transverse to the removal direction. A substantially rod-shaped lateral prop for propping up the container bases extends parallel to the associated rest and away from the rest support propping up the container end having the larger diameter.

U.S. Pat. No. 9,251,724 B2, granted on Feb. 2, 2016, to HOTTMANN et al., relates to "beverage identification tiles". This document describes a beverage identification tile that includes a sheet of material and a plurality of beverage type identifiers. The sheet of material has a first face and a second face which have a polygonal shape defined by a plurality of edges. A different beverage type identifier of the plurality of beverage type identifiers is printed along each edge of the plurality of edges of the first face and of the second face. A shelf labeling system includes a shelf, a plurality of slots, and the beverage identification tile. The shelf includes a front wall, a back wall, and a base mounted between the front wall and the back wall. The sheet of material is sized to slide into a slot of the plurality of slots formed in the front wall along an edge of the front wall with a beverage type identifier visible above the edge.

US patent application No. 2013/0146552 A1 made public on Jun. 13, 2013, in the name of GRIMES, relates to a "storage system". This document describes a storage system for storing objects. The storage system may include a frame having sides and a guide rail system supported on the frame between the frame sides, the guide rail system including a pair of slide members that are selectively extendable beyond the frame sides. The storage system may further include a tray moveable within the guide rail system and releasably supported by the pair of slide members for movement with the slide members relative to the frame, the tray may be selectively removable from the slide members and tiltable with respect to the slide members, and a mounting mechanism operable for securing the tray to one of the slide members, the mounting mechanism being selectively releasable for allowing manual removal of the tray from the slide members.

Document No. CN 203897879, made public on Oct. 29, 2014, relates to a "wine constant-temperature display cabinet". Based on the machine-translated abstract, this document describes a wine constant-temperature display cabinet comprising a cabinet body and a support arranged at the bottom of the cabinet body, wherein a transparent glass door is arranged in the front of the cabinet body, a plurality of layers of wine racks are arranged in the cabinet body, the layers of wine racks include the bottom layer wine rack arranged on the bottom of the cabinet body, ordinary layer racks arranged in the middle of the cabinet body and multifunctional wine racks arranged on the upper portion of the cabinet body, a refrigerating unit is arranged at the bottom of the cabinet body, an air heater and a temperature controller are arranged on the top of the cabinet body, the air heater is arranged on the left side of the top of the cabinet body, the temperature controller is arranged on the right side of the top of the cabinet body, a pressure sensor is further arranged on the temperature controller, and the lower portion of the temperature controller is connected with a humidifier. The wine constant-temperature display cabinet is simple, elegant and steady in appearance design and suitable for storing different types of wine in the same cabinet body; due to the arranged push-and-pull storage frames, no peculiar smells exist, a user can conveniently take the wine, and the wine constant-temperature display cabinet is elegant in appearance.

Document No. CN 205493139, made public on Aug. 24, 2016, relates to a "wall hanging type wine cabinet". Based on the machine-translated abstract, this document describes a wall hanging type wine cabinet, wherein the intelligent cabinet temperature adjusting device comprises a cabinet body, the cabinet physically has a storing room that is used for placing the beverage bottle, the cabinet body is including a plurality of settings between the storing indoor portion both sides be used for supporting the beverage bottle first supporting part, and a plurality of settings be in indoor portion middle part is used for supporting the second supporting part of beverage bottle bottleneck between the storing, first supporting part with the one-to-one setting of second supporting part sets up so that the beverage bottle level is placed first supporting part staggered arrangement on the direction of height of indoor portion both sides between the storing, highly the difference in height of two close first supporting parts is less than beverage bottle diameter. The utility model discloses a wall hanging type wine cabinet, compact structure, space utilization is high, is difficult for bumping bad beverage bottle, and elegant appearance is fit for the family and uses.

Document No. DE 20 2013 105 392 U1, made public on Feb. 11, 2014, relates to a "shelf". Based on the machine-translated abstract, this document describes a shelf of wires with floors for the representative arrangement of bottles, characterized in that each floor for the bottles of transverse and longitudinal wires.

Also known to the Applicant(s) are the following US documents that describe various other types of cellars, and/or corresponding shelving systems: U.S. Pat. Nos. 3,403,789; 8,132,871 B1; 9,326,602 B2; 2006/0219648 A1; 2009/0120886 A1; 2009/0152219 A1; 2009/0178427 A1; 2012/0273444 A1; 2015/0034577 A1; and 2016/0183679 A1.

Also known to the Applicant are the following documents: CA 2,472,096; DE 10 2014 108 579 A1; FR 1,577,963; FR 2,929,812; JP 2001-197975; JP 2001-240225; WO 2005/048779 A1; and WO 2005/055766 A1.

Despite these known systems and improvements, there is always a need to continue innovating and finding better and/or different ways of storing bottles within a confined space, such as a cellar, for example, in a quicker, easier, simpler, faster, more efficient, more reliable, more compact, more environmentally-friendly, more cost-effective, more economical, more versatile, and/or more desirable manner.

SUMMARY OF THE INVENTION

An object of the present invention is to provide a shelving system which, by virtue of its design and components, proposes a solution to the above-mentioned need, and which is thus an improvement over other related shelving systems and/or shelving methods known in the prior art.

In accordance with the present invention, the above object is achieved, as will be easily understood from the present description, with a shelving system (also referred to herein as a "rack system") such as the one briefly described herein and such as the one exemplified in the accompanying drawings.

More particularly, according to one aspect of the present invention, there is provided a shelving system for storing and displaying bottles within a cellar, the shelving system comprising:

at least one rack for supporting and displaying bottles, the least one rack being mountable onto a given wall of the cellar and being displaceable with respect to said given wall so as to be displaced in and out of the cellar along an operative directional axis; and at least one recess provided about the at least one rack, each recess being positioned, shaped and sized for receiving a corresponding bottle, and each recess being disposed about the at least one rack, at an angle with respect to the operative directional axis of the at least one rack, so as to allow peripheral side surfaces of bottles resting on the at least one rack to face a front portion of the cellar.

According to another aspect of the present invention, there is provided an confined storage space (ex. a cellar, etc., and/or a corresponding portion thereof) provided with the above-mentioned shelving system.

According to yet another aspect of the invention, there is also provided a method of assembling and/or mounting the above-mentioned shelving system onto a corresponding confined storage space (ex. cellar, etc.).

According to yet another aspect of the invention, there is also provided a method of using the above-mentioned shelving system and/or confined storage space.

According to yet another aspect of the invention, there is also provided a kit with corresponding components for assembling the above-mentioned shelving system and/or confined storage space.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of doing business with the above-mentioned shelving system, confined storage space (ex. cellar), components thereof, kit, set and/or method(s).

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
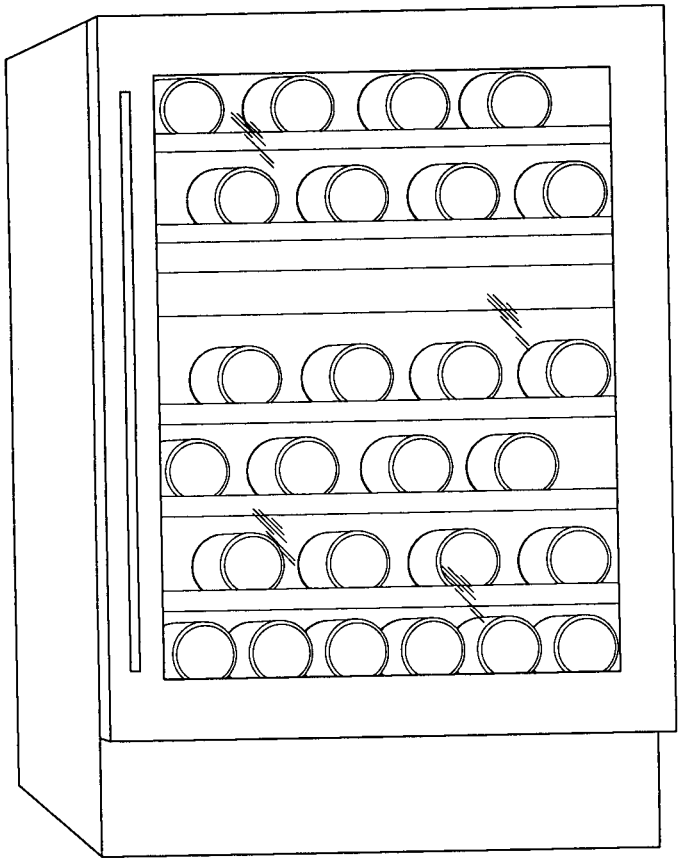
FIG. 1 (PRIOR ART)
FIG. 1 is a perspective view of a conventional cellar.
Figure 2:
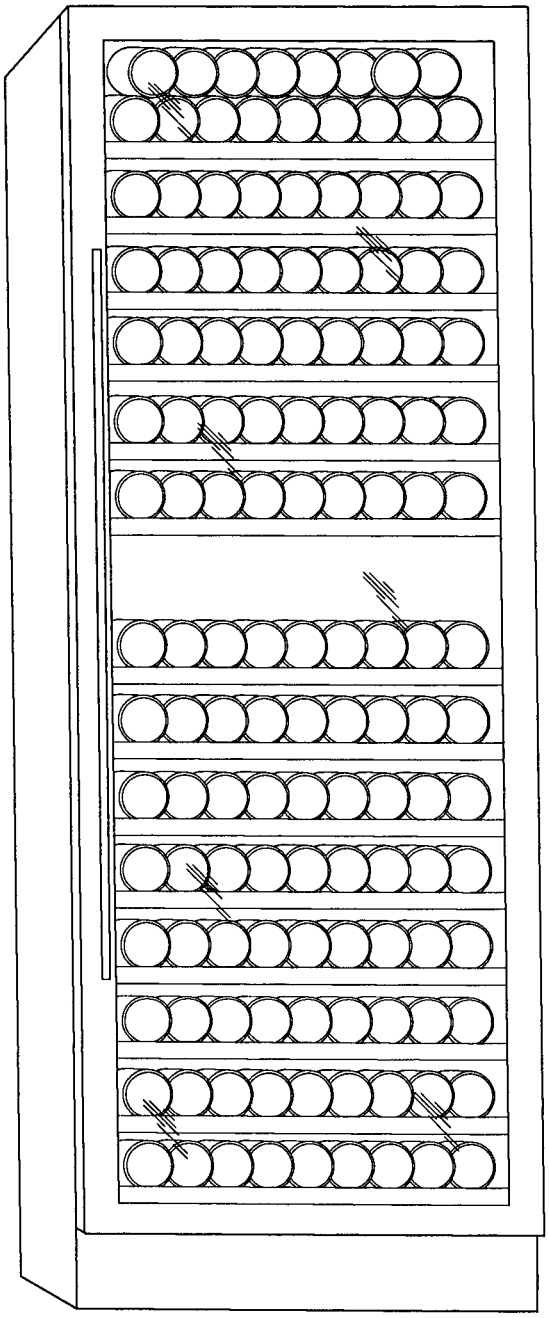
FIG. 2 (PRIOR ART)
FIG. 2 is a perspective view of another conventional cellar.
Figure 3:
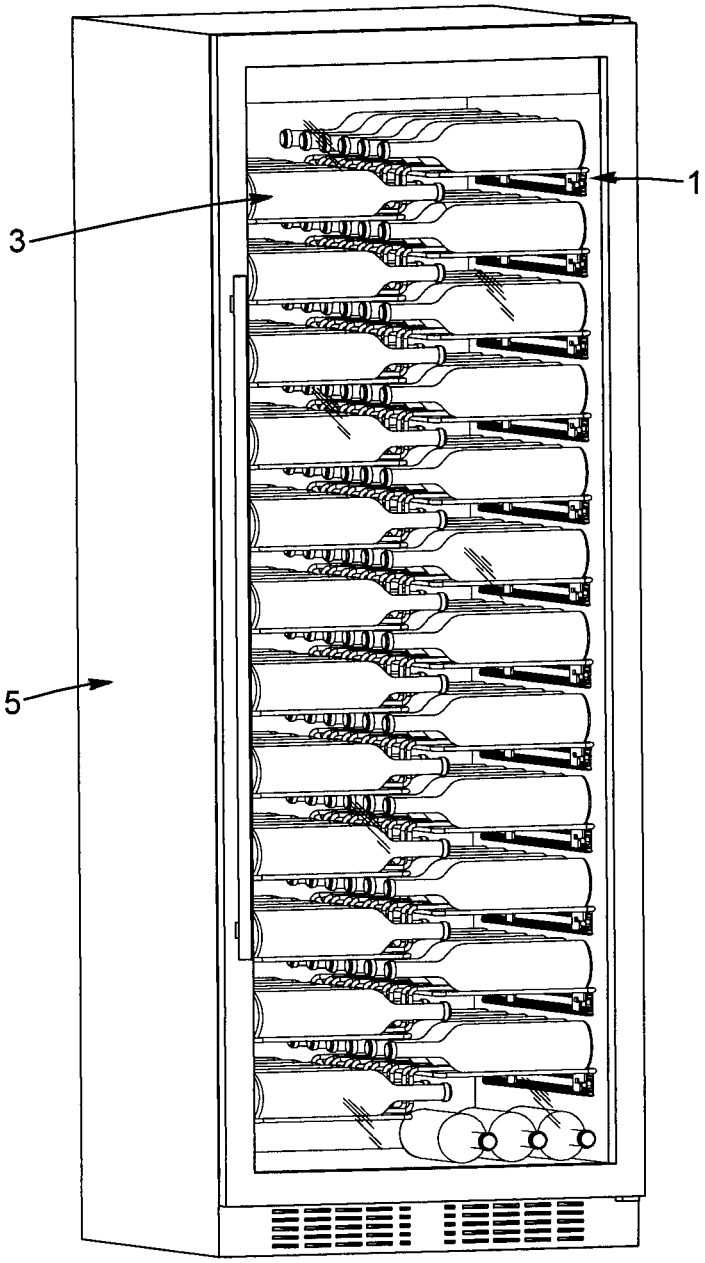
FIG. 3 is a picture presenting a perspective view of a cellar including a shelving system for storing and displaying bottles according to a possible embodiment of the present system.
Figure 4:
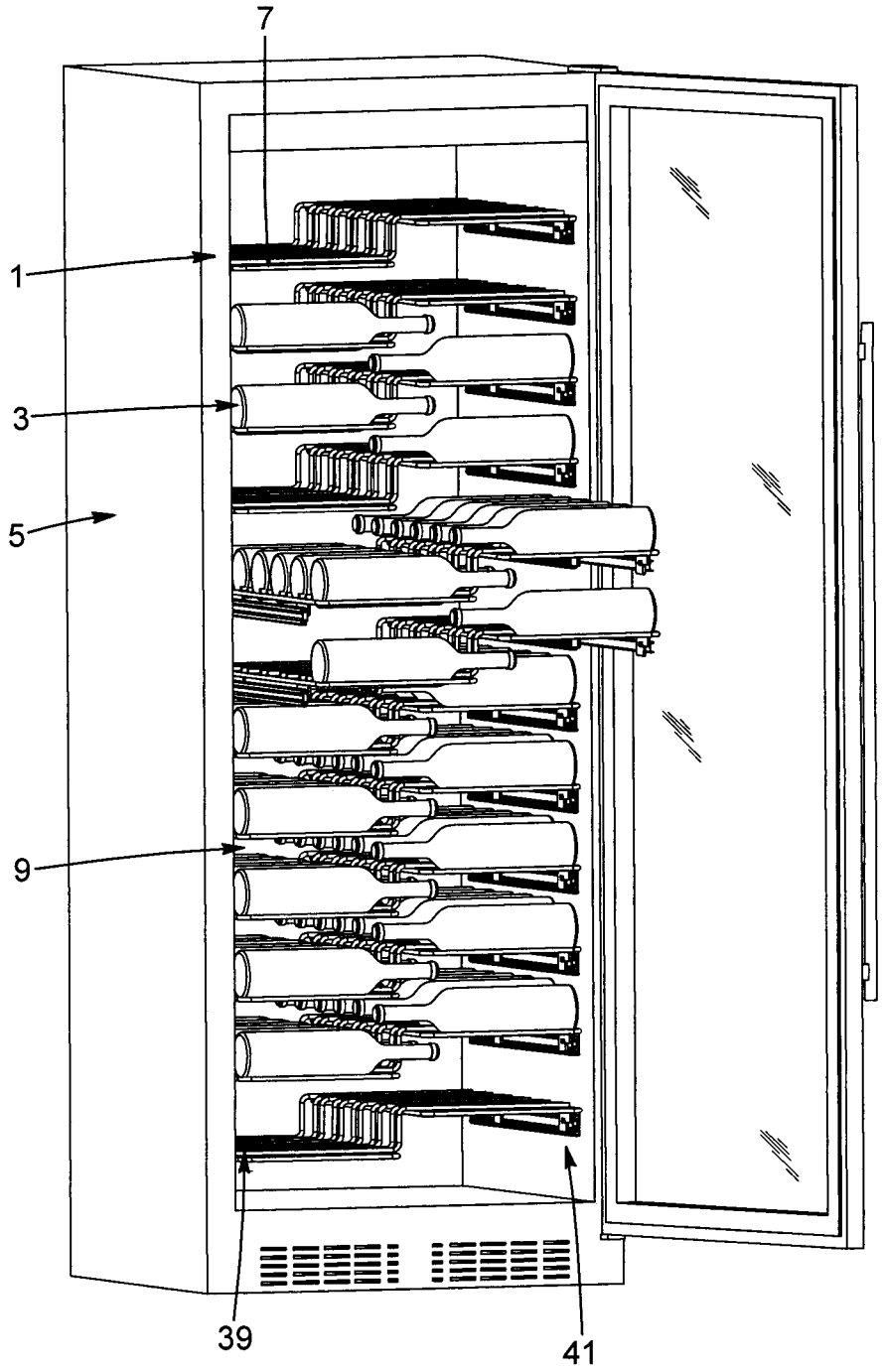
FIG. 4 is another view of what is shown in FIG. 3, the cellar being now shown with its door in an opened configuration.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed for use with "wine bottles" in a contained and/or confined space (ex. "box", etc.), whether an "opened" space or a "closed" space, such as a cellar, for example, and/or the like, for example, it may be used with other objects and/or in other types of applications, as apparent to a person skilled in the art. For this reason, expressions such as "wine", "bottle", "contained", "confined", "space", "area", "box", "opened", "closed", "cellar", etc., used herein should not be taken so as to limit the scope of the present invention and include all other kinds of objects (ex. room, wine cellar, root cellar, refrigerator, etc.) and/or applications (ex. containment purposes, displaying applications, preservation purposes, etc.) with which the present invention could be used and may be useful.

Moreover, in the context of the present invention, the expressions "shelving", "system", "device", "apparatus", "product", "unit", "rack", "equipment", "assembly", "method" and "kit", as well as any other equivalent expressions and/or compounds word thereof known in the art will be used interchangeably, as apparent to a person skilled in the art. This applies also for any other mutually equivalent expressions, such as, for example: a) "supporting", "storing", "containing", "displaying", "showing", etc.; b) "shelf", "rack", "tier", "support", etc.; c) "contained spacer", "box", "cellar", "refrigerator", etc.; d) "connected", "secured", "mounted", "riveted", etc.; e) "hingedly", "pivotably", "rotatably", etc.; f) "moveable", "displaceable", "sliding", "gliding", "rotating", "skidding", "nesting", "telescopically", "relatively", etc.; g) "track", "rail", "guide", "path", etc.; h) "securing", "restraining", "affixing", "holding", "fastening", "adjusting", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that all elongated objects will have an implicit "longitudinal axis" or "centerline", such as the longitudinal axis of shaft for example, or the centerline of a coiled spring, for example, and that expressions such as "connected" and "connectable", or "mounted" and "mountable", may be interchangeable, in that the present invention also relates to a kit with corresponding components for assembling a resulting fully assembled and operational shelving system (and/or a resulting contained space, such as a cellar for example, including the same, etc.).

Moreover, components of the present system(s) and/or steps of the method(s) described herein could be modified, simplified, altered, omitted and/or interchanged, without departing from the scope of the present invention, depending on the particular applications which the present invention is intended for, and the desired end results, as briefly exemplified herein, and as also apparent to a person skilled in the art.

In addition, although the preferred embodiments of the present invention as illustrated in the accompanying drawings comprise various components, and although the preferred embodiments of the shelving system and corresponding parts as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the shelving system and corresponding parts according to the present invention, as will be briefly explained herein, and as can be easily inferred herefrom by a person skilled in the art, without departing from the scope of the present invention.

Broadly described, and as better exemplified in the accompanying drawings, the present invention relates to a shelving system for storing and displaying bottles within a cellar, in a quicker, easier, simpler, faster, more efficient, more reliable, more compact, more environmentally-friendly, more cost-effective, more economical, more versatile, and/or more desirable manner, than what is possible with other conventional systems, and most importantly, in order to allow peripheral side surfaces of bottles (and/or labels thereof, etc.) resting on the at least one rack to face a front portion of the cellar, in order to facilitate identifying and selection of bottles within the cellar, by a corresponding user, etc.

LIST OF NUMERICAL REFERENCES FOR SOME OF THE CORRESPONDING POSSIBLE COMPONENTS ILLUSTRATED IN THE ACCOMPANYING DRAWINGS

1. shelving system
3. bottle
5. cellar
7. rack
9. wall
11. operative directional axis
13. recess
15. angle
17. peripheral side surface

19. front portion (of the cellar)
21. double-tiered rack
23. pair of offsetting portions
25. first portion (of the at least one rack)
27. first level (of the shelving system)
29. second portion (of the at least one rack)
31. second level (of the shelving system)
33. left-side portion
35. right-side portion
37. inner wall (of the cellar)
39. first inner wall (of the cellar)
41. second inner wall (of the cellar)
43. first horizontal plane (of the cellar)
45. second horizontal plane (of the cellar)
47. offsetting distance
49. connection assembly
51. rod section
53. common rod section
55. first recess
57. second recess
59. metallic rod
61. bottle neck
63. central portion
65. sliding track
67. rod section
69. contained space
71. door
73. closed configuration/position
75. opened configuration/position
77. handle
79. temperature indicator
81. design component
83. storage zone
85. front louver
87. digital display
89. control component
91. power ("on/off") switch
93. automatic control panel lock
95. LED lighting
97. temperature controller
99. temperature display
101. width
103. depth
107. height
109. inclination angle Broadly described, the present invention, as illustrated in the accompanying drawings, relates to a shelving system (1) for storing and displaying bottles within a cellar (5). According to a possible intended use of the present system, it can also relate to a shelving system (1) for cellars (5) that can be manually-operated, and having racks (7) designed to store and display bottles sideways and which can be displaced using an appropriate mechanical roller and/or a sliding rail and/or a series of articulated linkages, as will be understood in greater detail when referring to the following description and the enclosed drawings.

The present shelving system (1) may come in the various shapes and/or forms and may include one and/or several of the following possible components and features (and/or different combination(s) and/or permutation(s) thereof, etc.):

For example, according to a possible embodiment of the present system, there is provided a shelving system for storing and displaying bottles within a cellar. The shelving system may comprise at least one rack for supporting and displaying bottles, the at least one rack being mountable onto a given wall of the cellar and being displaceable with respect to said given wall so as to be displaced in and out of the cellar along an "operative directional axis", for example. The shelving system may also comprise at least one recess provided about the at least one rack, each recess being positioned, shaped and sized for receiving a corresponding bottle, and each recess being disposed about the at least one rack, at an angle with respect to the operative directional axis of the at least one rack, so as to allow peripheral side surfaces of bottles resting on the at least one rack to face a front portion of the cellar.

According to one possible embodiment, the at least one rack is a double-tiered rack, and the at least one rack may include a pair of offsetting supporting portions, each offsetting supporting portion being configured for supporting corresponding bottles thereon, a first supporting portion of the at least one rack being disposed on a first level of the cellar, and a second supporting portion of the at least one rack being disposed on a second level of the cellar being different from the first level.

As can be easily understood from the accompanying drawings, a first supporting portion of the at least one rack may be positioned lower than a second supporting portion of the at least one rack, whereas alternatively, a first supporting portion of the at least one rack may be positioned higher than a second portion of the at least one rack.

Similarly, a first side portion of the at least one rack may a left-side portion of the least one rack, whereas a second side portion may be a right-side portion of the at least one rack, or "vice-versa".

According to a possible embodiment, a first lateral portion of the at least one rack is mountable onto a corresponding inner wall of the cellar, and/or a second lateral portion of the at least one rack is mountable onto a corresponding inner wall of the cellar (whether the same inner wall, and/or a different one). Optionally, the first and second lateral portions of the at least one rack may be respectively mountable onto different first and second inner walls of the cellar.

As can be easily understood from the accompanying drawings, a first straight portion of the at least one rack is substantially extendable along a corresponding first horizontal plane of the cellar, whereas a second straight portion of the at least one rack is substantially extendable along a corresponding second horizontal plane of the cellar.

Optionally, first and second straight portions of the at least one rack can be substantially extendable along corresponding different first and second horizontal planes respectively of the cellar, and offsetting horizontal planes within the at least one rack can be separated by an offsetting distance.

According to a possible embodiment, first and second body portions of the at least one rack are mechanically connected to one another via a corresponding connection assembly.

Optionally also, the shelving system may include at least one pattern of rods defining offsetting first and second structural portions of the at least one rack, each structural portion being configured for supporting corresponding bottles thereon.

The at least one pattern of rods can further define the at least one recess provided about the at least one rack, each recess being positioned, shaped and sized for receiving a corresponding bottle, and each recess being disposed about the at least one rack, at an angle with respect to the operative directional axis of the at least one rack, so as to allow peripheral side surfaces of bottles resting on the at least one rack to face a front portion of the cellar.

A common section of rods may be used for defining both first and second recesses on offsetting first and second structural portions of the at least one rack.

The common section of rods may also be used for mechanically connecting the together the offsetting first and second structural portions of the at least one rack, and each rod section may be made of metallic rods, for example.

Figure 5:
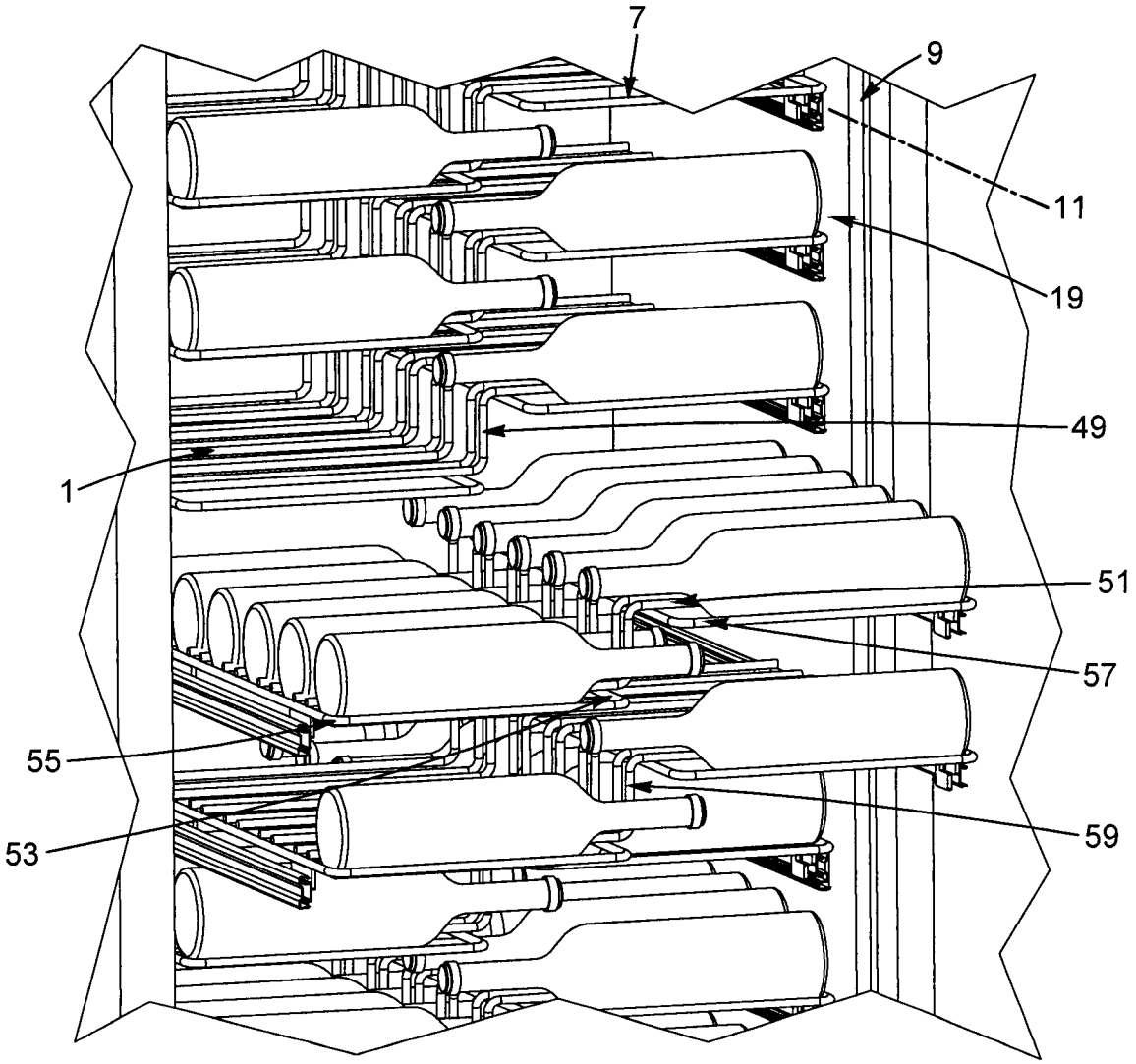
FIG. 5 is a representation illustrating a close-up view of the shelving system for storing and displaying bottles within a cellar according to a possible embodiment of the present system.
Figure 6:
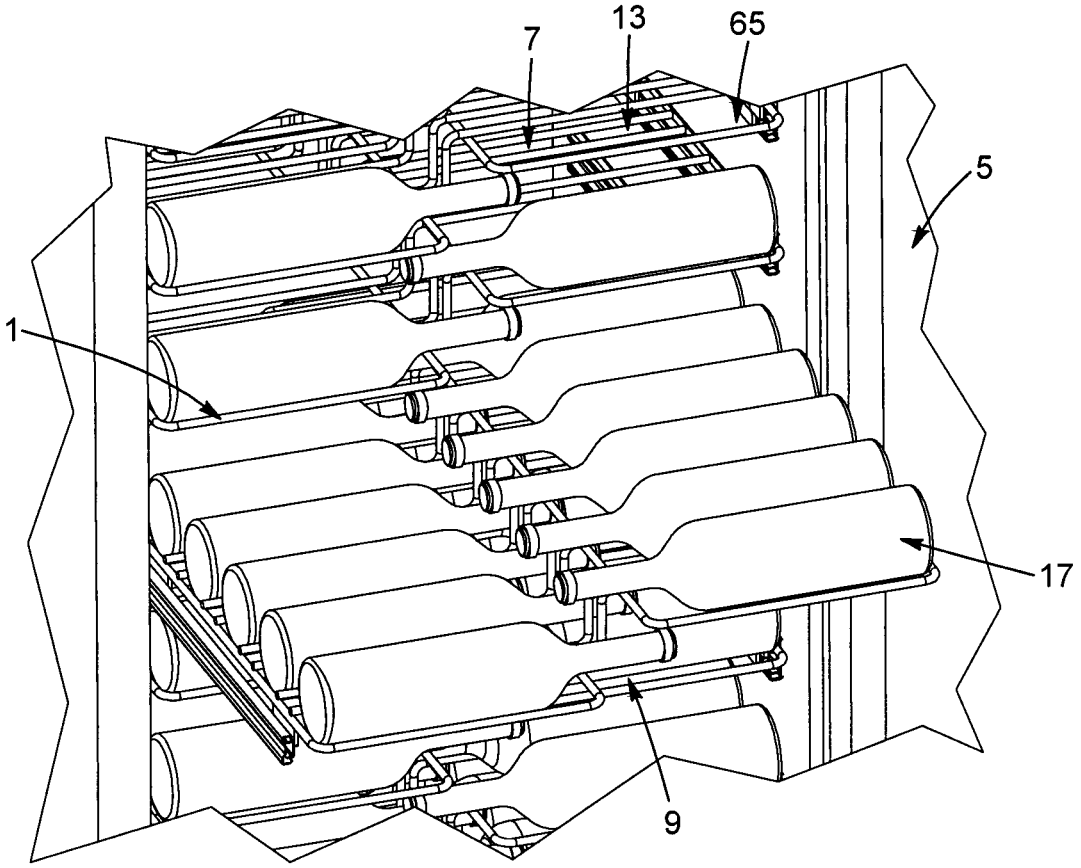
FIG. 6 is a representation of the shelving system shown in FIG. 5.
Figure 7:
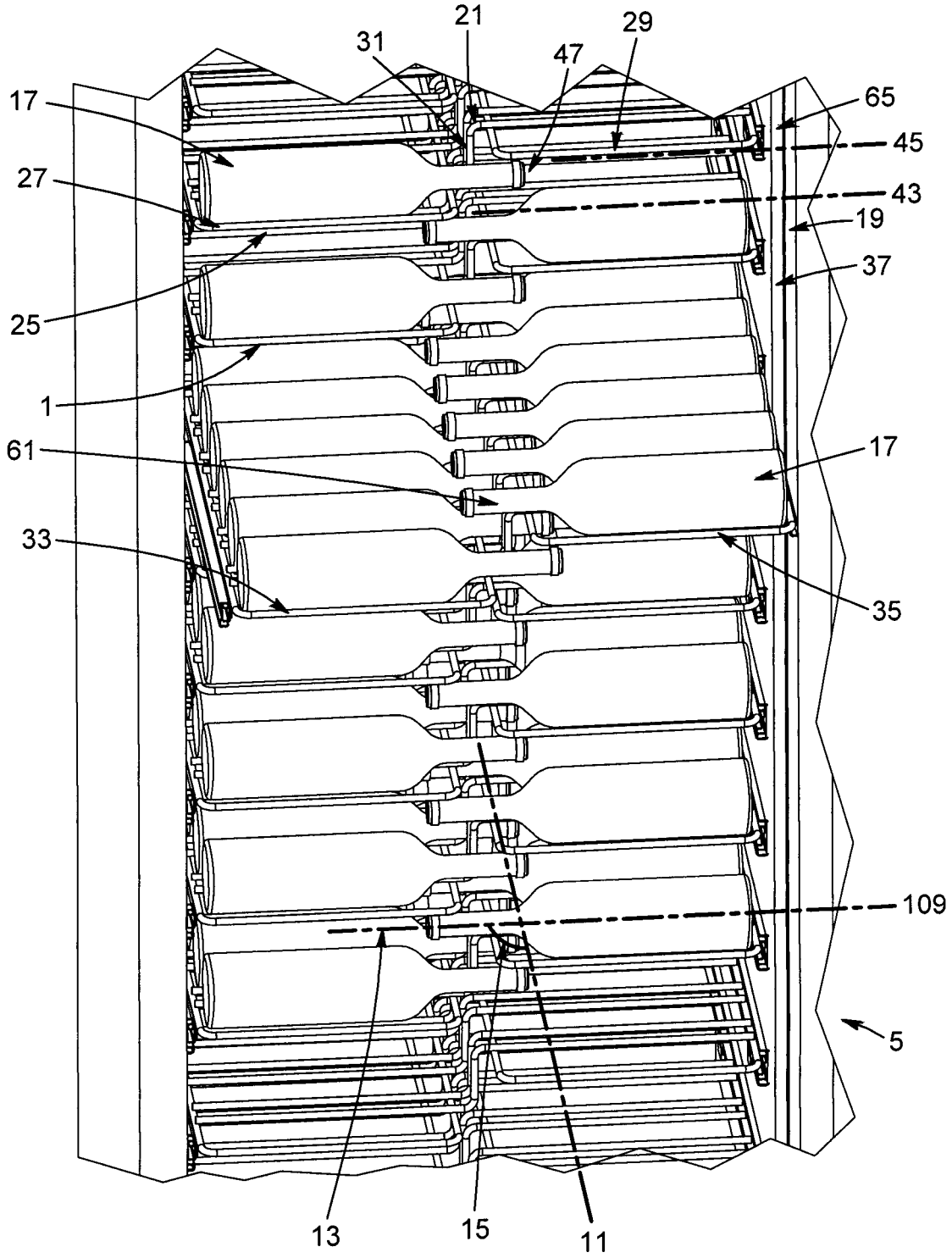
FIG. 7 is a representation showing a front view of the shelving system shown in FIG. 5.

Indeed, a grouping of metallic rods being welded together can be used to structurally define at least one given common rack of the shelving system, as better shown in FIGS. 5-7, for example.

Optionally, and as also shown, the shelving system comprises a plurality of different racks, each being made of a corresponding grouping of metallic rods being welded together.

As can be easily understood from the accompanying drawings, first and second recesses on offsetting first and second receiving portions of the at least one rack are positioned, shaped and sized so that necks of a pair of corresponding bottles placed respectively onto said first and second recesses overlap one another within the cellar about a central portion of the at least one rack.

As can also be easily understood from the accompanying drawings, the shelving system may include at least one sliding track mountable onto the given wall of the cellar and being configured for displacing the at least one rack in and out of the cellar.

Optionally, the shelving system can include a pair of sliding tracks for displacing the at least one rack in and out of the cellar. Preferably, the shelving system can include a pair of distally-apart sliding tracks, each sliding track being mountable onto a corresponding wall (ex. side wall(s), top wall(s), bottom wall(s), and wall(s), etc.) of the cellar and being configured for displacing the at least one rack in and out of the cellar. In either case, the at least one rack is fixedly connectable to a corresponding sliding track of the shelving system, and various other suitable types of assortments and/or arrangements can be used to set the at least one rack to come in and out of the cellar, etc.

Following is a technical description of different other components and features of the present shelving system according to other possible and/or optional embodiments:

For example, and as previously explained, and referring now more specifically to FIGS. 3 to 7, a shelving system (1) for storing and displaying bottles (3) within a cellar (5) is shown. The shelving system (1), as illustrated, comprises at least one rack (7). The at least one rack (7) aims at supporting and displaying bottles (3) and is mounted onto a given wall (9) of the cellar (5). Furthermore, the at least one rack (7) is displaceable with respect to the given wall (9), so as to be displaced in and out of the cellar (5) along an "operative directional axis" (11), for example. The shelving system (1) also comprises at least one recess (13) provided about the at least one rack (7). Each recess (13) is positioned, shaped and sized for receiving a corresponding bottle (3), meaning that the corresponding bottle (3) can be placed and stored in a stable fashion onto the recess (13). As illustrated, the recess (13) has a rectangular cross-section for allowing bottles (3) to rest sideways, meaning that peripheral side surfaces (17) of the bottles (3) are substantially parallel to the cross-section of the recess (13). Alternatively, the recess (13) can have an oval, square, elliptical, and/or any other suitable cross-sectional shape, and is aimed at allowing the peripheral side surfaces (17) of the bottles (3) to be substantially parallel to the cross-section of the recess (13).

The recess (13) is disposed about the at least one rack (7), at an angle (15) with respect to the operative directional axis (11) of the at least one rack (7), so as to allow the peripheral side surfaces (17) of the bottles (3) resting on the at least one rack (7) to face a front portion (19) of the cellar (5).

In the embodiments illustrated, the angle (15) is approximately 90 degrees (i.e. "face-on"). The angle (15) of approximately 90 degrees allows the user to see the peripheral sides (17) of the bottles (3), "face-to-face", from outside of the cellar (5). The bottles (3) have labels provided onto their peripheral side surfaces (17). The angle (15) of approximately 90 degrees hence allows seeing a maximal portion of the label, which is visible from outside the cellar (5). Consequently, the user does not need to open a door of the cellar (5) in order to identify, select, search or find the bottles (3). The labels are typically wine labels, but can also take various forms such as stickers, engraving, etching, painting and/or any other means informing the user of the content of the bottles (3) and/or of any other relevant information to the selection of the bottles (3).

Alternatively, the angle (15) may be different than 90 degrees. For instance, the angle (15) may be selected so as to be acute, obtuse, right and/or straight. The angle (15), as shown, can be different from 0 or 180 degrees, in order to allow the user to see the peripheral side surfaces (17) of the bottles (3) in a different perspective. The angle (15) is generally chosen so as the peripheral side surfaces (17) of the bottles not only face the front portion (19) of the cellar (5), but are also visible by the user from outside of the cellar (5), even if at angle with respect to the cellar, etc.

In the embodiments illustrated in the accompanying drawings, the at least one rack (7) is a double-tiered rack (21). The at least one rack (7) includes a pair of offsetting portions (23) and each portion of the offsetting portions (23) are configured for supporting corresponding bottles (3) thereon. The at least one rack (7) comprises a first portion (25), disposed on a first level (27) of the cellar, and a second portion (29), disposed on a second level (31) of the cellar. The first and second levels (27,31) correspond to a vertical position within the cellar with respect with a top and/or bottom portion of the cellar. In the illustrated embodiment, the second level (31) is different from the first level (27), meaning that, for example, and without being limitative, the first level (27) is positioned at a first vertical position that is different than a second vertical position to which is positioned the second level (31). Furthermore, at least one recess (13) is provided on each one of the first and second portions (25, 29).

In the embodiments illustrated, the first portion (25) of the at least one rack (7) is positioned lower than the second portion (29) of the at least one rack (7). Alternatively, the first portion (25) of the at least one rack (7) can be positioned higher than a second portion (29) of the at least one rack (7) or at the same level.

The first portion (25) is a left-side portion (33) of the least one rack (7) and the second portion (29) is a right-side portion (35) of the at least one rack (7). The first portion (25), corresponding to the left-side portion (33) of the at least one rack (7), is mounted onto a corresponding inner wall (37) of the cellar (5). In a similar fashion, the second portion (29), corresponding to the right-side portion (35) of the at least one rack (7), is mounted onto a corresponding inner wall (37) of the cellar (5). In the illustrated embodiment, the first and second portions (25,29) of the at least one rack (7) are respectively mounted onto different first and second inner walls (39,41) of the cellar (5). Alternatively, the first and second portion (25,29) can be mounted onto the same inner wall (37).

In the embodiments illustrated, the first portion (25) of the at least one rack (7) is substantially extendable along a corresponding first horizontal plane (43) of the cellar (5). Similarly, the second portion (29) of the at least one rack (7)

is substantially extendable along a corresponding second horizontal plane (45) of the cellar (5).

The first and second portions (25,29) of the at least one rack (7) are substantially extendable along corresponding different first and second horizontal planes (43,45) of the cellar (5), respectively. The first and second portions (25,29) are separated by an offsetting distance (47), resulting in offsetting horizontal planes (43,45) within the at least one rack (7) and also resulting in offsetting first and second portions (25,29).

As illustrated in FIG. 5, the first and second portions (25,29) of the at least one rack (7) can be mechanically connected to one another via a corresponding connection assembly (49).

More particularly, the shelving system (1) includes rod sections (51) defining the offsetting first and second portions (25,29) of the at least one rack (7). Each portion (25,29) can be configured for supporting corresponding bottles (3) thereon. Distance between the rod sections, as well as their dimensions, are selected so as to receive bottles of different format, but typically containing about 750 ml (on average, for example).

The rod sections (51) further define the at least one recess (13) provided about the at least one rack (7). As previously explained, each recess (13) is positioned, shaped and sized for receiving the corresponding bottle (3), and is disposed about the at least one rack (7), at an angle (15) with respect to the operative directional axis (11). The peripheral side surfaces (17) of the bottles (3) resting on the at least one rack (7) thus face the front portion (19) of the cellar (5).

The shelving system (1) further comprises a common rod section (53). The common rod section (53) is used for defining both first and second recesses (55,57) on offsetting first and second portions (25,29) of the at least one rack (7). As configured, the first and second recesses (55,57) have a substantially rectangular cross-section.

The common rod section (53) is used for mechanically connecting together offsetting first and second portions (25,29) of the at least one rack (7). Alternatively, the first and second portions (25,29) of the at least one rack (7) can be connected together with different means, such as "welding", and/or any other suitable equivalents, such as gluing, press-fitting, fasteners (ex. bolts, screws, etc.) and/or the like. More specifically, the common rod section (53) is aimed at joining the first and second portion (25,29) of the at least one rack (7) in a stable manner.

In the illustrated embodiments of FIGS. 3 to 7, each rod section (51) is made of a metallic rod (59). Alternatively, the rod section (51) can be made from plastic, wood, or any other suitable material having the required structural properties for connecting the offsetting first and second portions (25,29).

Figure 11:
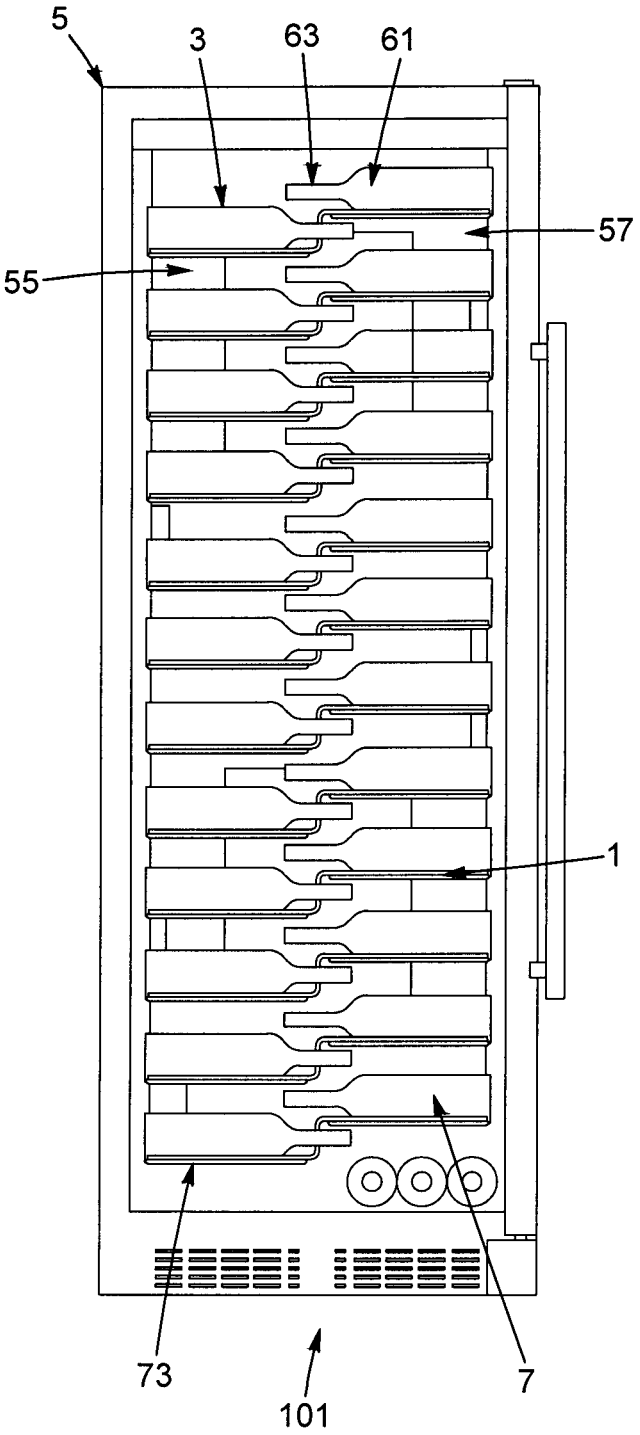
FIG. 11 is a front view of what is shown in FIG. 9, the cellar being now shown with its door in an opened configuration.

In the configuration illustrated in FIG. 11, the first and second recesses (55,57) of the offsetting first and second portions (25,29) of the at least one rack (7) are positioned, shaped and sized so that necks (61) of a pair of corresponding bottles (3) placed respectively onto said first and second recesses (55,57) overlap one another within the cellar (5) about a central portion (63) of the at least one rack (7).

Referring back to FIGS. 6 and 7, the shelving system (1) may include at least one sliding track (65) mounted onto the given wall (9) of the cellar (5), and is configured for displacing the at least one rack (7) in and out of the cellar (5).

The shelving system (1) may include a pair of sliding tracks (65) (only one of the pair of sliding tracks (65) is shown on FIG. 7 for displacing the at least one rack (7) in and out of the cellar (5)). More particularly, the pair of sliding tracks (65) can be separated by a horizontal distance (i.e. each sliding track (65) is distally-apart from one another), meaning that each sliding track (65) is mounted onto a given wall (9) of the cellar and are configured for displacing the at least one rack (7) in and out of the cellar (5). In the illustrated embodiment, the given wall (9) of the cellar (5) is a corresponding inner side wall (37) of the cellar (5). Furthermore, one of the pair of sliding racks (65) is mounted onto a first inner wall (39) of the cellar (5), while another one of the pair of sliding rack (65) is mounted onto the second inner wall (41) of the cellar (5). In the illustrated embodiment, the first and second inner walls (39,41) are different inner side walls (37) of the cellar (5).

The rod section (51) of the at least one rack (7) is fixedly connected to its corresponding sliding track (65) of the shelving system (1). For instance, the rod section (51) can be fixedly connected to the corresponding sliding track (65) about one of its end portions.

Now referring to FIGS. 9 to 13, a cellar (5) with a shelving system (1) comprising the features and components previously described is shown.

The cellar (5) includes a contained space (69) for receiving therein a plurality of racks (7) and corresponding bottles (3). The contained space (69) can be accessible via a corresponding door (71) operable between closed and opened configurations (73,75).

In the illustrated embodiment, the door (71) is a glass and a reversible door. Furthermore, a corresponding handle (77) is provided onto the door (71).

Alternatively, the door (71) can be embodied by different accessing means, such as window, sliding door, swing door, or any type of accessing means allowing to access the contained space (69) of the cellar (5), while being substantially visually transparent and/or comprising means for visually inspecting at least a portion of the interior of the cellar (5) or the contained space (69).

In the illustrated embodiment, the contained space (69) of the cellar (5) is insulated and/or temperature-regulated, meaning that that a temperature set by the user or any other means is constant and does not substantially vary in time.

Figure 8:
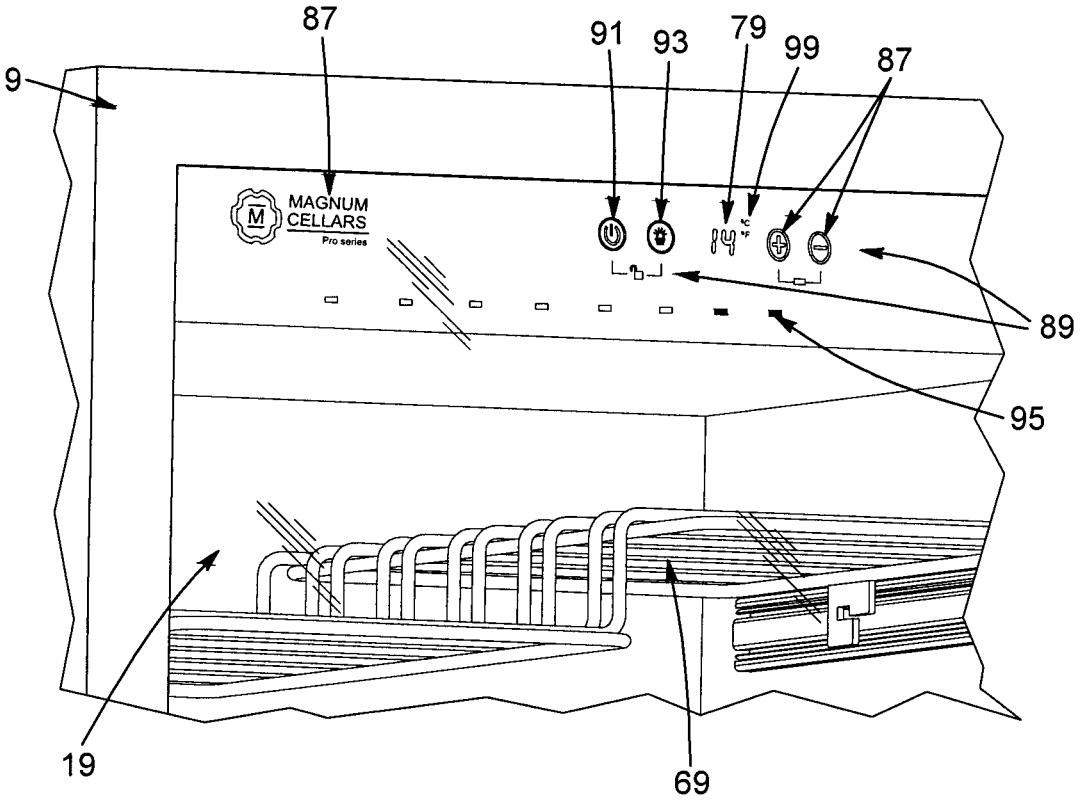
FIG. 8 is a representation illustrating a control component of a cellar according to a possible embodiment of the present system.
Figure 9:
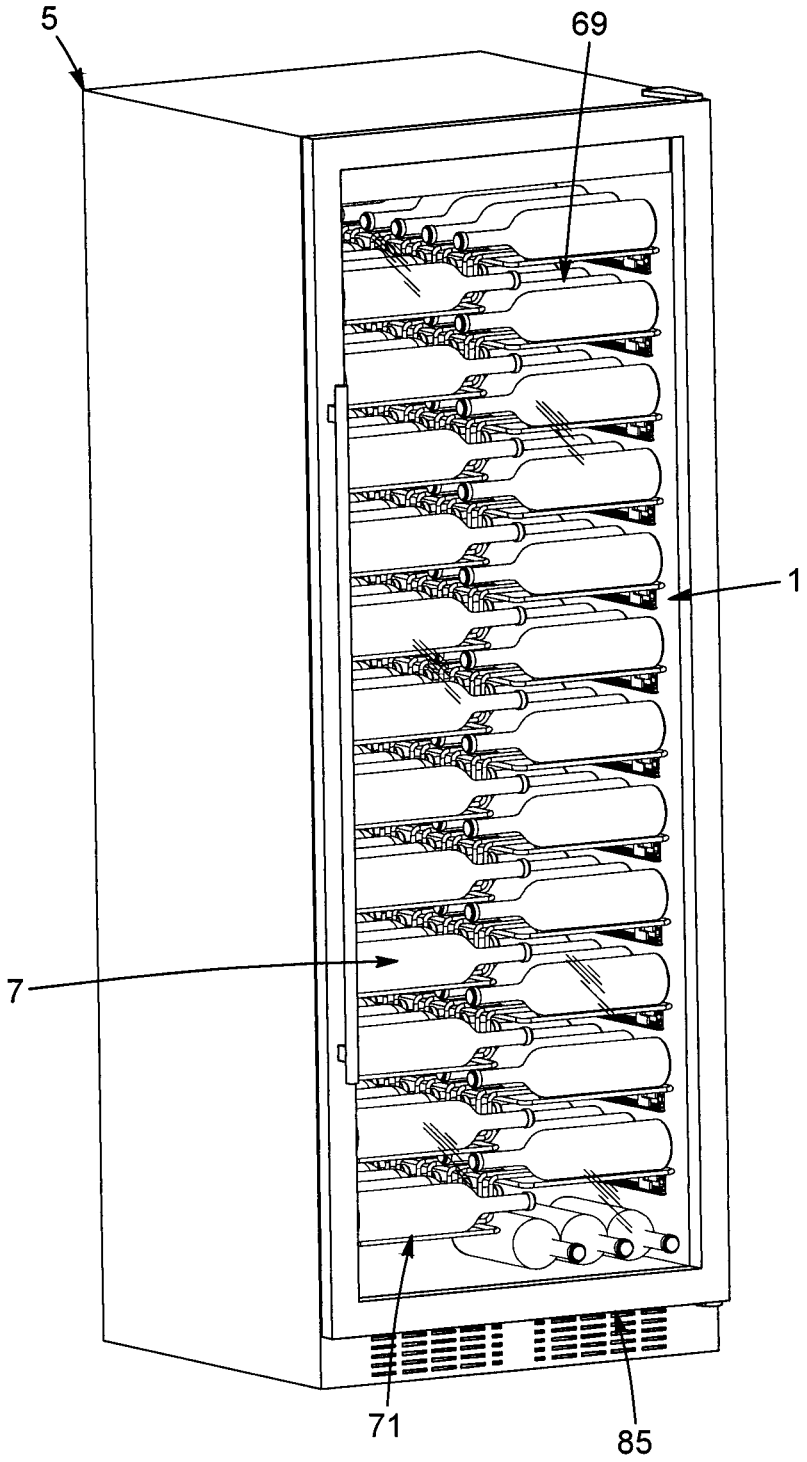
FIG. 9 is a left perspective view of a cellar including a shelving system for storing and displaying bottles according to another possible embodiment.
Figure 10:
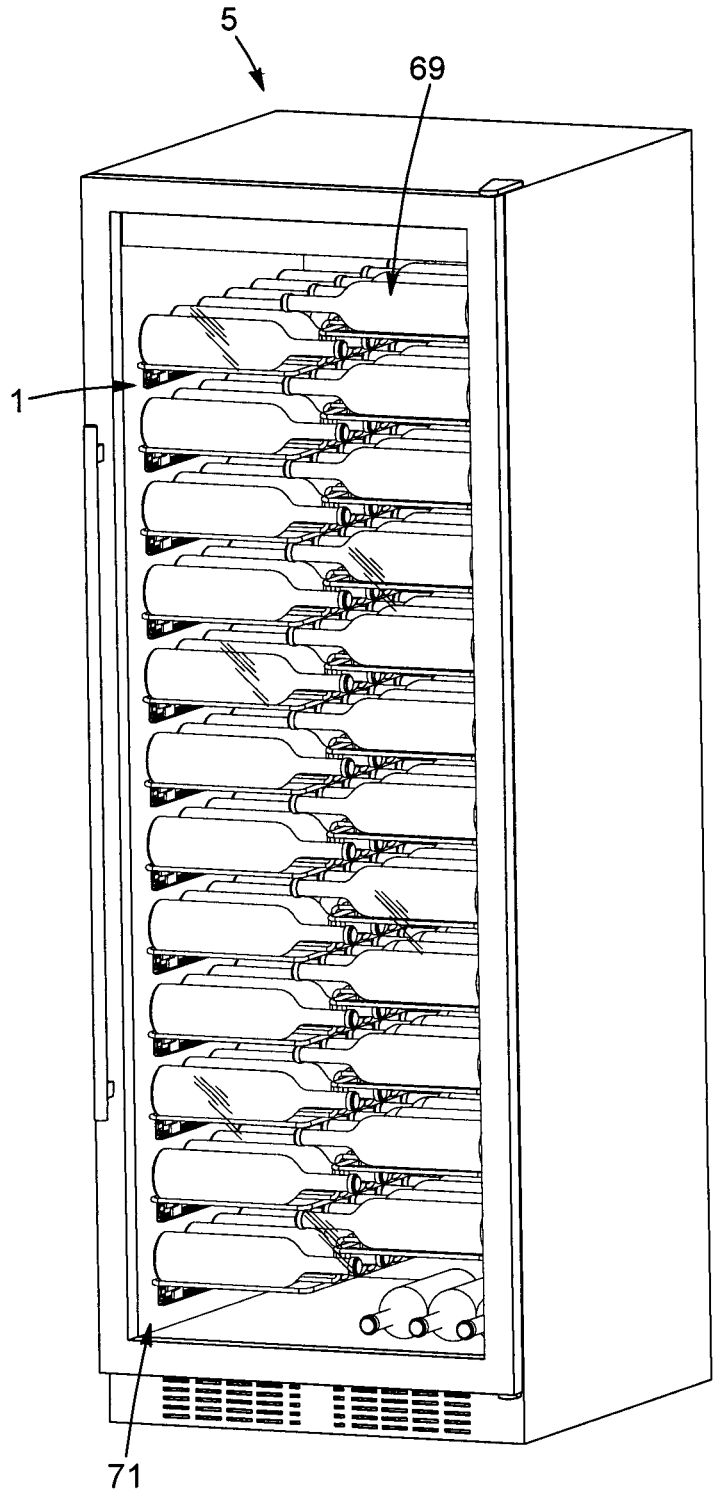
FIG. 10 is a right perspective view of what is shown in FIG. 9.

Referring back to FIGS. 8 and 9, the cellar (5) is also provided with a temperature indicator (79) for indicating an inside temperature within the contained space (69) of the cellar (5).

In the illustrated embodiment, the cellar (5) is provided with at least one design component (81) selected from the group consisting of a storage zone (83), front louver (85) design for built-under installation, 13 pull-out shelves (each one corresponding to one rack (7)), reversible door (71), digital display (87) and stainless steel handle bar (77). The reversible door (71) can comprise smoked-tempered glass, for example.

The cellar (5) can be provided with at least one control component (89) selected from the group consisting of power on/off switch (91), automatic control panel lock (93), LED lighting (95), temperature controller (97) for setting the temperature between about 5° C. and about −22° C., and a Fahrenheit and/or Celsius display (99).

Moreover, the cellar (5) is provided with at least one feature component selected from the group consisting of low vibration, maximizing humidity up to (80%, CFC & HCFC free, auto defrosting, quiet Embraco™ compressor (about (40 dB), and built-in lock.

Figure 12:
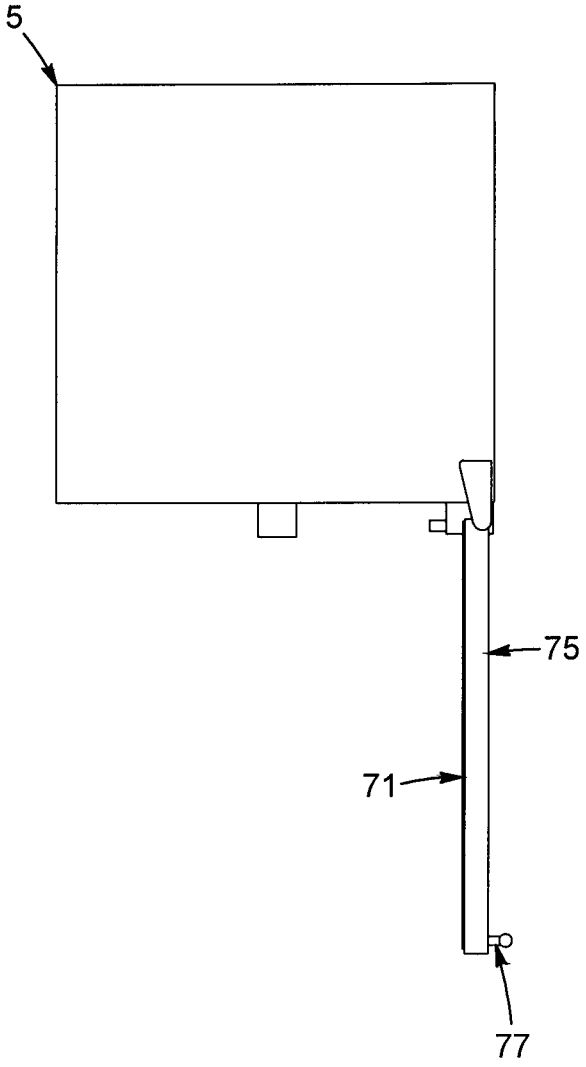
FIG. 12 is a top view of what is shown in FIG. 11.
Figure 13:
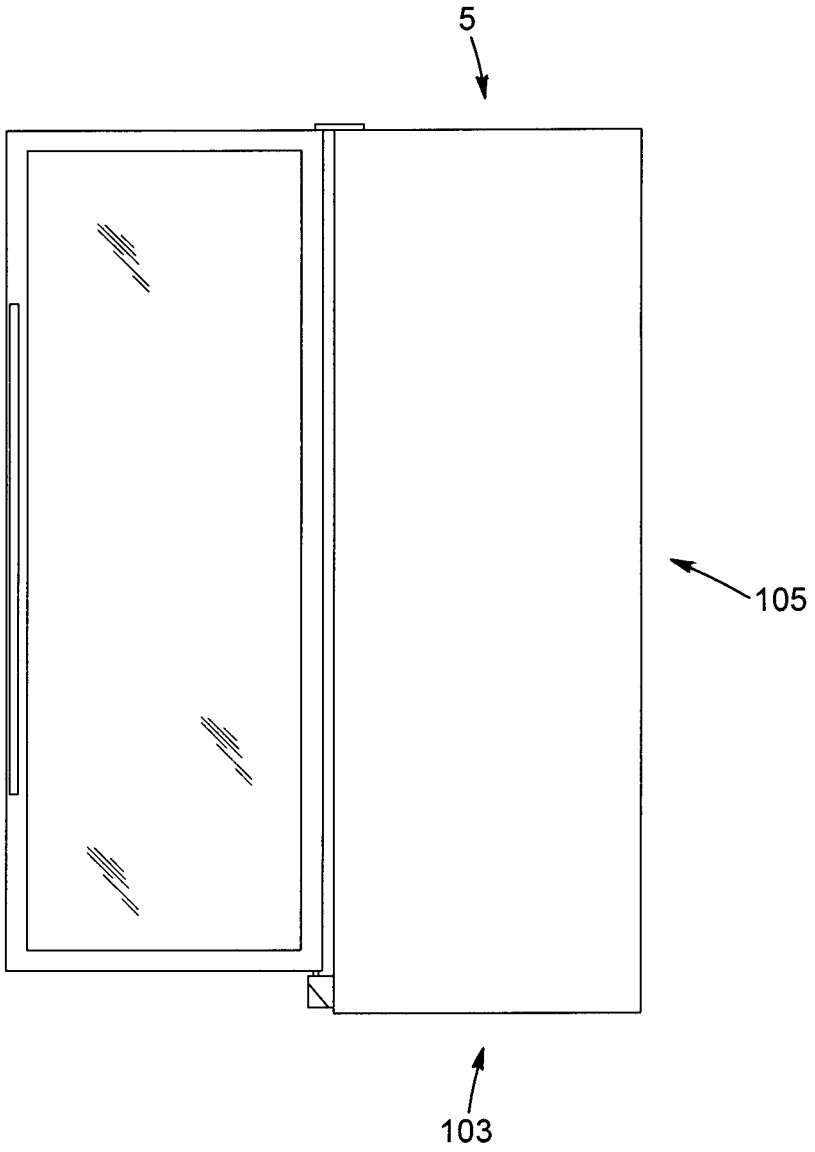
FIG. 13 is a side view of what is shown in FIG. 12.

The cellar (5) illustrated in the embodiments shown in FIGS. 11 to 13 has a width (101), a depth (103) and a height (105). In one embodiment, dimensions of the cellar (5) are approximately 25.79 (in width)×26.77 (in depth)×72.24 (in height) (dimensions expressed herein in inches). Furthermore, such cellar (5) typically weighs about 106 kilograms.

Figure 14:
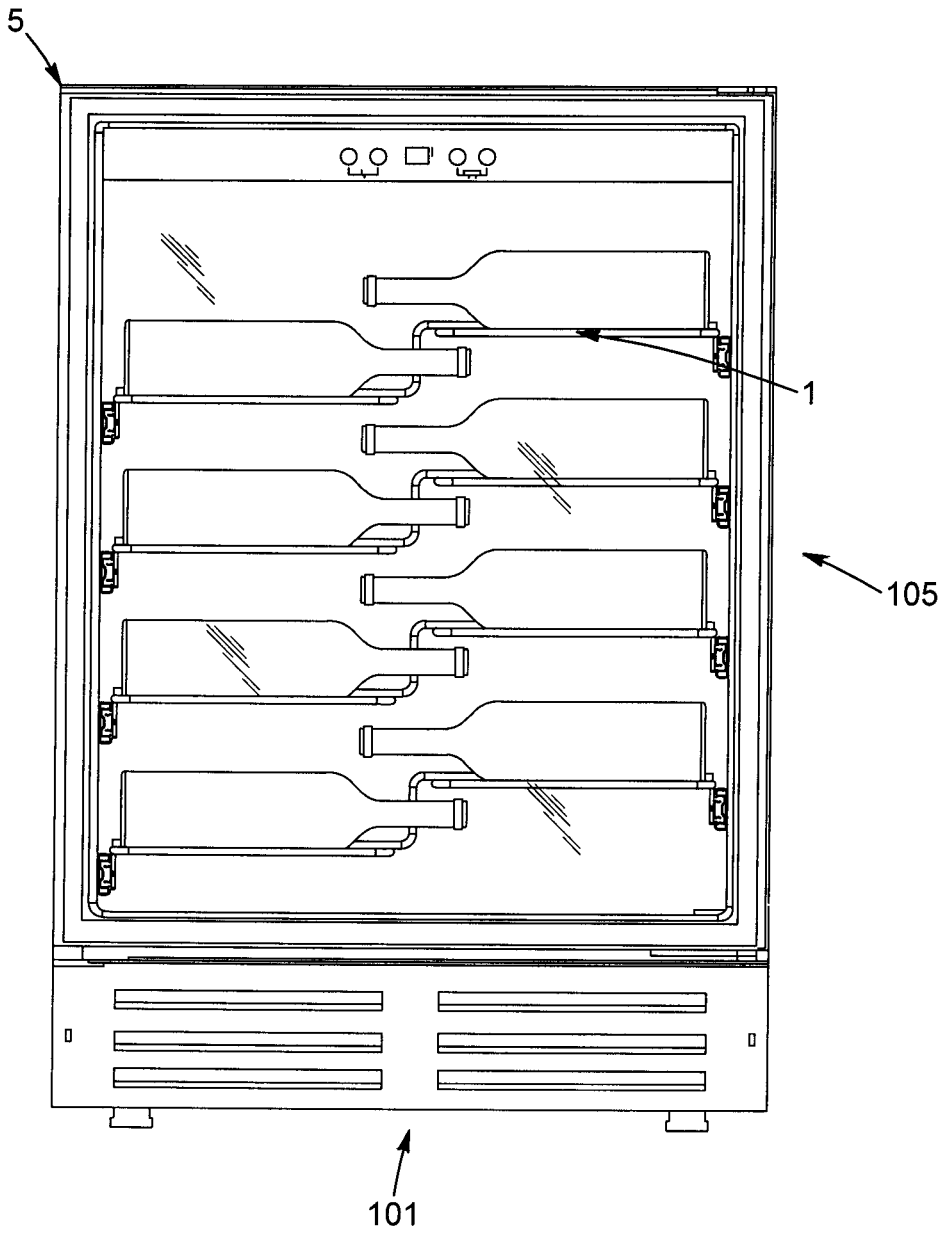
FIG. 14 is a front view of a cellar including a shelving system for storing and displaying bottles according to another possible embodiment of the present system.
Figure 16:
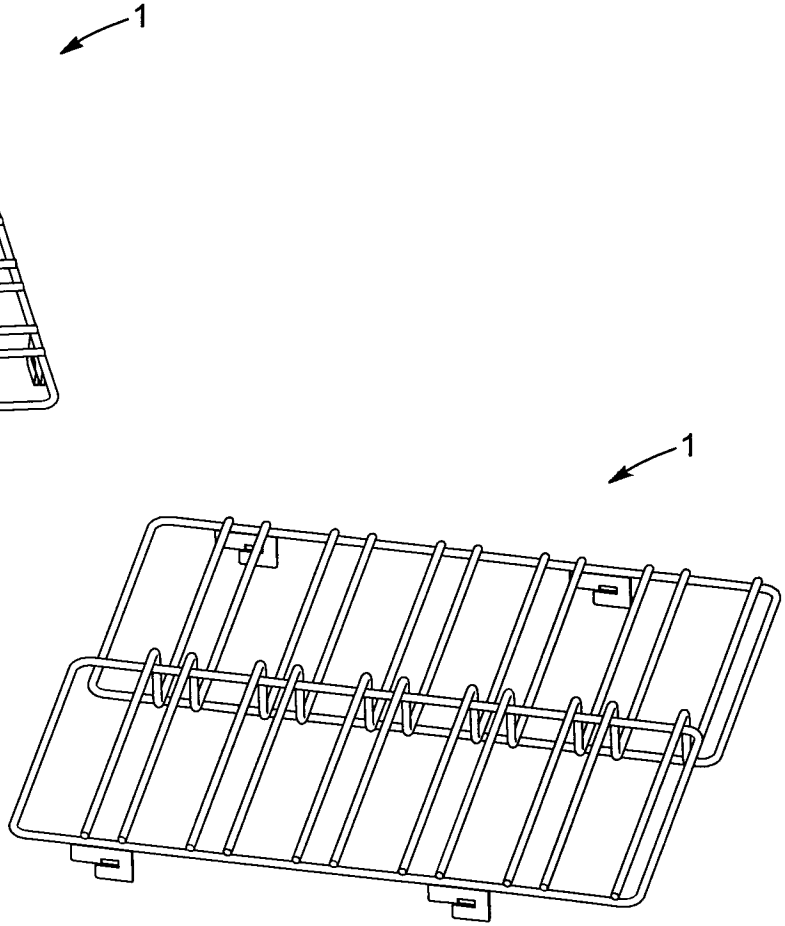
FIGS. 15-20 are different views of a shelving system, including rack and possible mounting accessories, according to another possible embodiment of the present invention.
Figure 15:
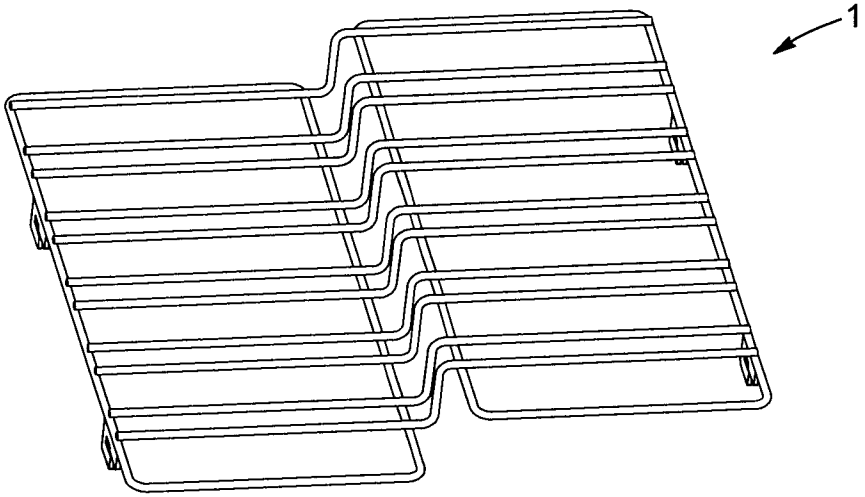
Figure 17:
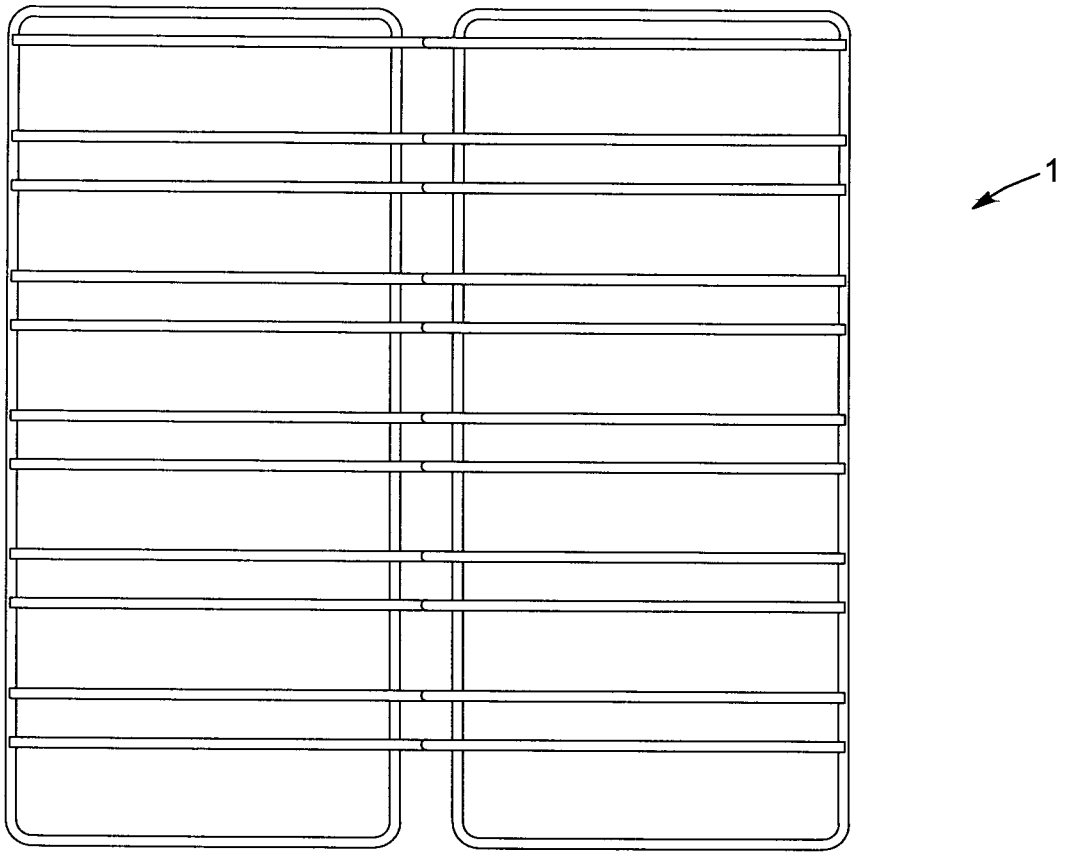
Figure 20:
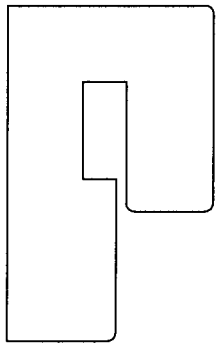
Figure 19:
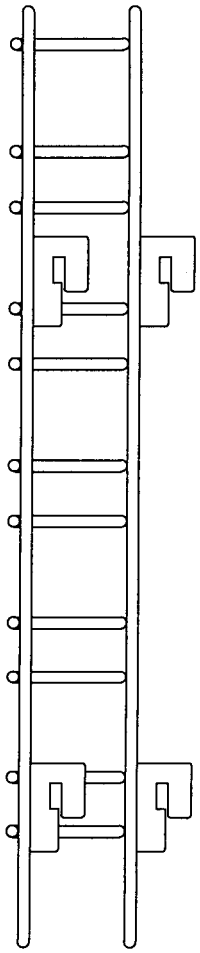
Figure 18:
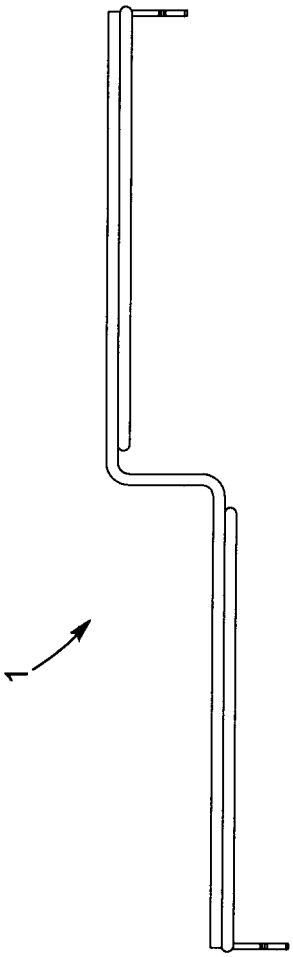

Alternatively and referring to FIG. 14, the cellar (5) can have dimensions of approximately 23.43" (in width)×22.20" (in depth)×34.25" (in height), for example. In this embodiment, the cellar (5) typically weighs about 46 kilograms, for example.

More generally, the cellar (5) is configured for receiving n−1 racks (7), where n is an integer equal to or greater than 2.

In the illustrated embodiment of FIGS. 4 to 7, the cellar (5) is configured for receiving 12 racks, for example. Furthermore, the cellar (5) according this embodiment is configured to have a bottle capacity of about 148 bottles.

More particularly, each rack (7) is configured to have a bottle capacity of about (12) bottles (3). That is, each portion (25,29) is configured to have a bottle capacity of about 6 bottles and each bottle (3) is provided onto a corresponding recess (13).

According to another aspect of the invention, there is provided a kit with components for assembling the shelving system (1) according to any one of the preceding combination(s) previously described. There is also provided a kit with components for assembling the cellar (5) according to any one of the preceding combination(s) and/or permutation(s).

The kit(s) can further include instructions. The instructions can be for example and without being limitative a method of assembling the shelving system (1) according to any one of the preceding combination(s) and/or permutation(s). Alternatively, a method of using the shelving system (1) according to any one of the preceding combination(s) and/or permutations(s) may be also provided.

According to another aspect of the invention, a contained space (69) is provided with a shelving system (1) according to any one of the preceding combination(s) and/or permutation(s). A kit with components for assembling the contained space (69) provided with the shelving system (1) according to any one of the preceding combination(s) and/or permutation(s) may further be provided. The kit may be accompanied by a method of assembling the contained space (69) provided with the shelving system (1) according to any one of the preceding combination(s) and/or permutation(s). Moreover, a method of using the contained space (69) provided with the shelving system (1) according to any one of the preceding combination(s) and/or permutation(s) may also be provided.

As may now be better appreciated, the present shelving system (1) is advantageous over in that it enables to store and display bottles (3) within a cellar (5), in a quicker, easier, simpler, faster, more efficient, more reliable, more compact, more environmental-friendly, more cost-effective, more economical, more versatile, and/or more desirable manner, than what is possible with other conventional systems, and most importantly, it allows peripheral side surfaces (17) of bottles (3) (and/or labels thereof, etc.) resting on the at least one rack (7) to face a front portion (19) of the cellar (5), in order to facilitate identifying and selection of bottles (3) within the cellar (5) by a user of the shelving system (1).

Thus, as may now also be better appreciated, the present shelving system (1) is also advantageous over conventional systems for various other reasons. Firstly, from an aesthetics properties point of view, the shelving system (1) as disclosed allows displaying the bottles (3) "sideways", which enables the possibility to see the peripheral side surfaces (17) of the bottles (and/or the label(s) thereof, or the like) from outside the cellar (5), resulting in an improved esthetical and/or functional cellar (5). Secondly, displaying the bottles (3) as previously described herein allows the users to obtain a visual/physical wine card, which facilitates the selection of the bottles (3) contained in the cellar (5) and can further be used as an interactive/dynamic wine card. Thirdly, the present shelving system (1) and corresponding cellar allow to visually inspecting an interior portion of the cellar without the need to open the door—consequently, the temperature within the cellar (5) is more stable and the air flow within the cellar (5) is not disturbed, and also, a lot of energy consumption is avoided, with is beneficial from an economic and an environmental perspective. Fourthly, the shelving system (1) and the cellar (5) have a large storage capacity, but their dimensions are compatible with standard dimension cellar. Indeed, the present shelving system (1) allows to maximize the presence of bottles (3) within a limited/standard confined space.

It is worth mentioning that several modifications could be made to the present shelving system and corresponding components, without departing from the scope of the present invention.

For example, the recess (13) as disclosed has rectangle cross-section. Alternatively, and as previously explained, the recess (13) can have an oval, square, elliptical, and/or any other suitable cross-sectional shape and is aimed at allowing the peripheral side surfaces (17) of the bottles (3) to be substantially parallel to the cross-section of the recess (13), and more importantly, to be exposed to a front portion of the cellar, etc.

Moreover, the recess (13) is at an angle (15) with respect with the operative directional axis (11). The recess (13) can further be at an inclination angle (109) with respect with the first and/or second horizontal planes (43,45). As shown in the Figures, the inclination angle (109) is approximately 0 degree, meaning that the peripheral side surfaces (17) of the bottles (3) is substantially parallel to first and/or second horizontal planes (43,45), and also, "face-on" to a front portion of the cellar. Alternatively, the inclination angle (109) can be different than 0 degrees, so as the bottles (3) are inclined with respect with the first and/or second horizontal planes (43,45). For example and without being limitative, the angle (15) can be approximately 0 degrees while the inclination angle (109) can be 90 degrees, so as the bottles (3) rests on its bottom portion, which also allows the user to see the peripheral side surfaces (17) of the bottles (3) from outside the cellar (5). It will readily be understood that the angle (15) and the inclination angle (109) can be chosen in order to maximize the storage capacity of the cellar (5) while allowing displaying the peripheral side surfaces (17) of the bottles (3) and their labels (and/or information thereof) and can be selected and/or adjusted to the specific needs of the user.

As illustrated in the embodiments shown in the accompanying figures, the shelving system (1) comprises a sliding shelf. Alternatively and without being limitative, the shelving system (1) can also comprise a retractable shelf, a shelf with fixed brackets, an adjustable slotted shelving system, a built-in shelving system, a floating shelving system, or the like. It will be understood that the shelving system (1) is aimed at storing and displaying bottles (3) within a cellar (5) and can differ in shape, dimensions, structure and/or composition according to the specific needs of the user.

The present shelving system (1) and corresponding parts (support frame, racks, etc.) are preferably made of substantially rigid materials, such as metallic materials (stainless steel, etc.), hardened polymers, composite materials, polymeric materials, and/or the like, so as to ensure a proper operation thereof depending on the particular applications for which the shelving system is intended and the different parameters (forces, moments, etc.) in cause, as apparent to a person skilled in the art.

Of course, and as can be easily understood by a person skilled in the art, the scope of the claims should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing form the scope and spirit of the present invention, as defined in the appended claims and as apparent to a person skilled in the art.

The invention claimed is:

1. A combination of cellar and shelving system for storing and displaying bottles within the cellar, the cellar having a closed and insulated space for containing the bottles therein, said closed and insulated space being accessible via a corresponding door operable between opened and closed configurations, the cellar further having a refrigerating assembly for refrigerating the bottles contained inside the cellar and to be displayed, and the door of the cellar being a glass door for allowing a visual display of the bottles contained inside the cellar through said glass door, the shelving system comprising:

a plurality of racks for supporting and displaying bottles, each rack being mountable onto a given inner side wall of the cellar and being displaceable with respect to said given inner side wall so as to be displaced in and out of the cellar along an operative directional axis; and at least one recess defined within each rack, each recess being positioned, shaped and sized for receiving a corresponding bottle, and each recess being disposed at an angle with respect to the operative directional axis of each rack, so as to allow peripheral side surfaces of bottles resting on the plurality of racks to face a front portion of the cellar;

wherein each rack of the plurality of racks includes a pair of offsetting supporting portions, each offsetting supporting portion being configured for supporting corresponding bottles thereon, a first supporting portion of each rack being disposed on a first level of the cellar, and a second supporting portion of each rack being disposed on a second level of the cellar being different from the first level;

wherein each rack is made of a corresponding grouping of metallic rods being welded together;

wherein a common section of rods is used for defining both first and second recesses on offsetting first and second structural portions of each rack; and wherein said offsetting first and second structural portions and associated recesses of each rack are positioned at differing heights within the same rack.

2. A combination of cellar and shelving system according to claim 1, wherein each rack is a double-tiered rack.

3. A combination of cellar and shelving system according to claim 1, wherein the first supporting portion of each rack is positioned lower than the second supporting portion thereof.

4. A combination of cellar and shelving system according to claim 1, wherein the first supporting portion of each rack is positioned higher than the second supporting portion thereof.

5. A combination of cellar and shelving system according to claim 1, wherein a first side portion of each rack is a left-side portion and wherein a second side portion of each rack is a right-side portion.

6. A combination of cellar and shelving system according to claim 1, wherein a first lateral portion of each rack is mountable onto a corresponding inner side wall of the cellar.

7. A combination of cellar and shelving system according to claim 6, wherein a second lateral portion of each rack is mountable onto a corresponding inner side wall of the cellar.

8. A combination of cellar and shelving system according to claim 7, wherein the first and second lateral portions of each rack are respectively mountable onto different first and second inner side walls of the cellar.

9. A combination of cellar and shelving system according to claim 1, wherein a first straight portion of each rack is substantially extendable along a corresponding first horizontal plane of the cellar.

10. A combination of cellar and shelving system according to claim 9, wherein a second straight portion of each rack is substantially extendable along a corresponding second horizontal plane of the cellar.

11. A combination of cellar and shelving system according to claim 10, wherein the first and second straight portions of each rack are substantially extendable along corresponding different first and second horizontal planes respectively of the cellar.

12. A combination of cellar and shelving system according to claim 1, wherein offsetting horizontal planes within each rack are separated by an offsetting distance.

13. A combination of cellar and shelving system according to claim 1, wherein first and second body portions of each rack are mechanically connected to one another via a corresponding connection assembly.

14. A combination of cellar and shelving system according to claim 1, wherein the shelving system includes at least one pattern of supporting rods defining the offsetting first and second structural portions of each rack, each structural portion being configured for supporting corresponding bottles thereon.

15. A combination of cellar and shelving system according to claim 14, wherein the at least one pattern of supporting rods further defines the at least one recess.

16. A combination of cellar and shelving system according to claim 1, wherein the common section of rods is used for mechanically connecting together the offsetting first and second structural portions of each rack.

17. A combination of cellar and shelving system according to claim 1, wherein the grouping of metallic rods being welded together is used to structurally define each rack of the shelving system.

18. A combination of cellar and shelving system according to claim 1, wherein the shelving system comprises a plurality of different racks, each being made of a given grouping of metallic rods being welded together.

19. A combination of cellar and shelving system for storing and displaying bottles within the cellar, the cellar having a closed and insulated space for containing the bottles therein, said closed and insulated space being accessible via a corresponding door operable between opened and closed configurations, the cellar further having a refrigerating assembly for refrigerating the bottles contained inside the cellar and to be displayed, and the door of the cellar being a glass door for allowing a visual display of the bottles contained inside the cellar through said glass door, the shelving system comprising:

a plurality of racks for supporting and displaying bottles, each rack being mountable onto a given inner side wall of the cellar and being displaceable with respect to said given inner side wall so as to be displaced in and out of the cellar along an operative directional axis; and at least one recess defined within each rack, each recess being positioned, shaped and sized for receiving a corresponding bottle, and each recess being disposed at an angle with respect to the operative directional axis of each rack, so as to allow peripheral side surfaces of bottles resting on the plurality of racks to face a front portion of the cellar;

wherein each rack of the plurality of racks includes a pair of offsetting supporting portions, each offsetting supporting portion being configured for supporting corresponding bottles thereon, a first supporting portion of each rack being disposed on a first level of the cellar, and a second supporting portion of each rack being disposed on a second level of the cellar being different from the first level;

wherein each rack is made of a corresponding grouping of metallic rods being welded together;

wherein a common section of rods is used for defining both first and second recesses on offsetting first and second structural portions of each rack;

wherein said offsetting first and second structural portions and associated recesses of each rack are positioned at differing heights within the same rack;

wherein each rack is a double-tiered rack;

wherein first and second lateral portions of each rack are respectively mountable onto opposite first and second inner side walls of the cellar;

wherein first and second straight portions of each rack are substantially extendable along corresponding different first and second horizontal planes respectively of the cellar;

wherein the first and second horizontal planes are offsetting with respect to each other within each rack and are separated by an offsetting distance;

wherein the first and second horizontal planes of each rack are mechanically connected to one another via a corresponding connection assembly; and wherein metallic rods being welded together are used to structurally define the first and second horizontal planes and corresponding connection assembly of each rack of the shelving system.

* * * * *